US007111343B1

(12) United States Patent
Bates

(10) Patent No.: US 7,111,343 B1
(45) Date of Patent: Sep. 26, 2006

(54) SPORTS COMFORTER OF SPORTS COMFORT BAG

(76) Inventor: Melinda Bates, 11719 Elmcroft Ave., Norwalk, CA (US) 90650

( * ) Notice: Subject to any disclaimer, the term of this patent is extended or adjusted under 35 U.S.C. 154(b) by 0 days.

(21) Appl. No.: 11/141,854

(22) Filed: May 31, 2005

Related U.S. Application Data

(60) Provisional application No. 60/669,231, filed on Apr. 6, 2005.

(51) Int. Cl.
*A47G 9/02* (2006.01)

(52) U.S. Cl. ..... 5/485; 5/417; 383/4
(58) Field of Classification Search ..... 5/417, 5/485; 383/4
See application file for complete search history.

(56) References Cited

U.S. PATENT DOCUMENTS

| | | | | |
|---|---|---|---|---|
| 2,898,609 | A | 4/1959 | Storie | |
| 4,466,516 | A | 8/1984 | Sicoli | |
| 4,516,668 | A * | 5/1985 | Grayek | 190/2 |
| 4,789,247 | A | 12/1988 | Schnoor | |
| D322,532 | S | 12/1991 | Kumar | |
| 5,457,829 | A * | 10/1995 | Elliott | 5/420 |
| 6,408,462 | B1 * | 6/2002 | Moore | 5/417 |
| 6,634,041 | B1 * | 10/2003 | Higashi et al. | 5/417 |
| 6,647,570 | B1 * | 11/2003 | Ong | 5/485 |

* cited by examiner

*Primary Examiner*—Michael Trettel

(57) ABSTRACT

An apparatus that serves both as a blanket, pillow, or a carrying bag. By default, the apparatus appears as a blanket with an external bag and strap attached to the blanket. Through careful folding of the blanket, the apparatus can be modified into a pillow or carrying bag and used as such.

3 Claims, 2 Drawing Sheets

SPORTS COMFORTER OF SPORTS COMFORT BAG

I. CROSS-REFERENCE TO RELATED APPLICATIONS

This application claims the benefit of U.S. Provisional Application No. 60/669,231, filed Apr. 6, 2005.

II. BACKGROUND OF THE INVENTION

The present invention concerns that of a new and improved apparatus that serves both as a blanket, pillow, or a carrying bag.

III. DESCRIPTION OF THE PRIOR ART

U.S. Pat. No. 4,789,247, issued to Schnoor, discloses a blanket with a pillow that is convertible into a bag.

U.S. Pat. No. 4,466,516, issued to Sicoli, discloses a combination tote bag, pillow and blanket assembly.

U.S. Pat. No. 2,898,609, issued to Storie, discloses a combination convertible blanket, pillow, and tote bag.

U.S. Pat. No. D322,532, issued to Kumar, discloses an ornamental design for a combination beach towel, pillow, pocket, and carrying strap that is convertible into a bag.

IV. SUMMARY OF THE INVENTION

The present invention concerns that of a new and improved apparatus that serves both as a blanket, pillow, or a carrying bag. By default, the apparatus appears as a blanket with an external bag and strap attached to the blanket. Through careful folding of the blanket, the apparatus can be modified into a pillow or carrying bag and used as such.

There has thus been outlined, rather broadly, the more important features of a household apparatus that the detailed description thereof that follows may be better understood and in order that the present contribution to the art may be better appreciated. There are, of course, additional features of the household apparatus that will be described hereinafter and which will form the subject matter of the claims appended hereto.

In this respect, before explaining at least one embodiment of the household apparatus in detail, it is to be understood that the household apparatus is not limited in its application to the details of construction and to the arrangements of the components set forth in the following description or illustrated in the drawings. The household apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present household apparatus. It is important, therefore, that the claims be regarded as including such equivalent constructions insofar as they do not depart from the spirit and scope of the present invention.

It is therefore an object of the present invention to provide a household apparatus which has all of the advantages of the prior art and none of the disadvantages.

It is another object of the present invention to provide a household apparatus which may be easily and efficiently manufactured and marketed.

It is another object of the present invention to provide a household apparatus which is of durable and reliable construction.

It is yet another object of the present invention to provide a household apparatus which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
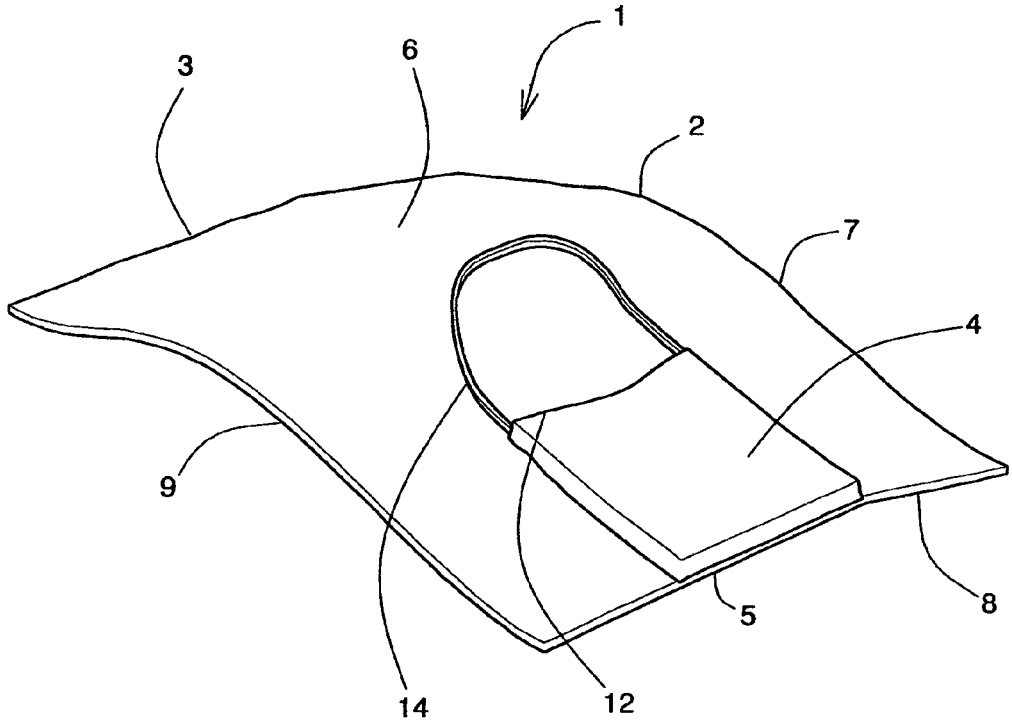
FIG. 1 shows a front perspective view of the apparatus showing the blanket with the external bag.

FIG. 1 shows a front perspective view of the apparatus 1 showing the blanket 2 with the external bag 4. Blanket 2 has two sides comprising a front side 6 and a rear side 8, and is preferably rectangularly-shaped. Although blanket 2 can have a wide variety of dimensions, the preferable dimension for blanket 2 is seventy inches in length and fifty inches in width. Blanket 2 also has a top edge 3, a bottom edge 5, a right edge 7, and a left edge 9.

Attached to the front side 6 of the blanket 2 is an external bag 4. External bag is a pouch that is closed on all sides except for its top side 12, which is open. The top side 12 has two ends, a first end and a second end. A strap 14 having two ends, a first end and a second end, is connected to the top side 12 of the external bag 4, with the first end of the strap 14 attached to the first end of the top side 12 and the second end of the strap 14 attached to the second end of the top side 12. The strap 14 is not connected to the blanket 2. When the blanket is open, however, the strap can be tucked away, along with personal articles, and zipped so you can cover yourself or lie on the blanket 2 without items falling out.

In the mode seen in FIG. 1, the blanket 2 can be used as a blanket. However, depending on various configurations and foldings that are done, the blanket 2 can have other uses as well.

Figure 2:
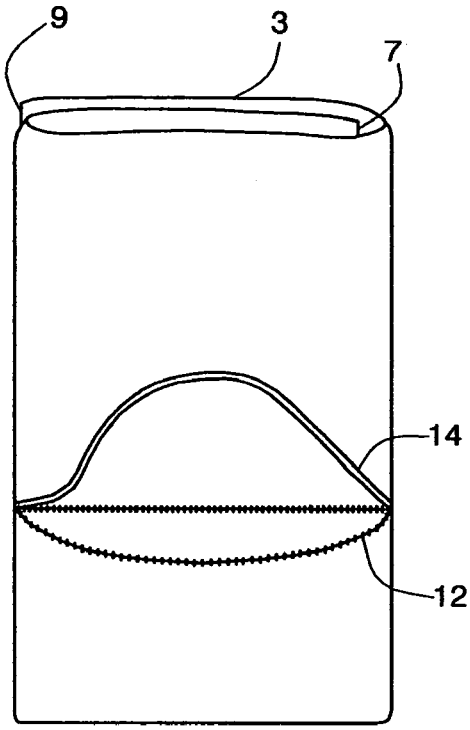
FIG. 2 shows the front view of the apparatus after each of the two edges have been folded rearward onto the rear side.
Figure 3:
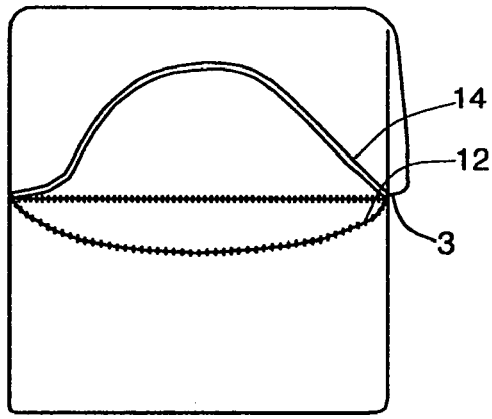
FIG. 3 shows the front view of the apparatus after the top one-third of the blanket has been folded rearward onto the rear side.

FIG. 2 shows the front view of the apparatus after the left edge 9 and the right edge 7 have been folded rearward onto the rear side. Next, FIG. 3 shows a front view of the blanket 2 after the top one-third of the blanket has been folded rearward onto the rear side. Next, FIG. 4 shows the front view of the blanket 2 after the next one-third of the blanket has been folded rearward onto the back surface.

Figure 4:
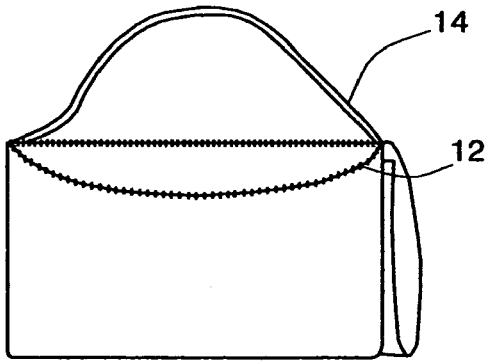
FIG. 4 shows the front view of the apparatus after the next one-third of the blanket has been folded rearward onto the rear side.

Once the apparatus 1 appears as it does in FIG. 4, the apparatus 1 can be used as a pillow. If that is the desire of an individual, then the individual merely needs to tuck the strap 14 into the top side 12 of the external bag 4.

At this point, if an individual wants to use the apparatus 1 as a handbag, the individual would place their hand through the top side 12 of the external bag 4 and grab the folded back material. Then, the material would be pulled upward into the bag until it formed a fold that would not "unfold" while the apparatus 1 was being carried around like a hand bag. A user could use the apparatus 1 as a handbag merely by carrying the apparatus 1 around with the strap 14 and placing items in the external bag 4.

I claim:

1. A household apparatus comprising:

a blanket having a front side, a rear side, a top edge, a bottom edge, a right edge, and a left edge, an external bag attached to the front side of the blanket, the external bag having a top side, the top side having a first end and a second end, the top side being open, a strap having a first end and a second end, the first end of the strap being connected to the first end of the top side of the external bag, the second end of the strap being connected to the second end of the top side of the external bag, and a zipper along the top side of the external bag for completely closing the open top side, wherein the left edge and the right edge are folded in a rearward direction toward the rear side, wherein the top edge is folded in a rearward direction toward the rear side, creating a folded section, wherein the folded section is folded in a rearward direction onto the back side, creating a folded blanket, and wherein the folded blanket is pulled upward into the bag.

2. A household apparatus according to claim 1 wherein the blanket is rectangular in shape.

3. A household apparatus according to claim 2 wherein the blanket has a length of seventy (70) inches and a width of fifty (50) inches.

* * * * *